US009194231B2

(12) United States Patent
Burgess et al.

(10) Patent No.: US 9,194,231 B2
(45) Date of Patent: Nov. 24, 2015

(54) MESH HANDLING APPARATUS AND RELATED METHODS

(71) Applicant: J.H. FLETCHER & CO., Huntington, WV (US)

(72) Inventors: Timothy D. Burgess, South Point, OH (US); Steven E. Payne, Portsmouth, OH (US); Henry E. Wilson, Ironton, OH (US)

(73) Assignee: J.H. FLETCHER & CO., Huntington, WV (US)

( * ) Notice: Subject to any disclaimer, the term of this patent is extended or adjusted under 35 U.S.C. 154(b) by 0 days.

(21) Appl. No.: 13/970,002

(22) Filed: Aug. 19, 2013

(65) Prior Publication Data

US 2014/0050532 A1 Feb. 20, 2014

Related U.S. Application Data

(60) Provisional application No. 61/684,423, filed on Aug. 17, 2012.

(51) Int. Cl.

| | |
|---|---|
| ***E21D 5/00*** | (2006.01) |
| ***E21D 11/15*** | (2006.01) |
| ***E21D 11/40*** | (2006.01) |
| ***E21D 20/00*** | (2006.01) |

(52) U.S. Cl.

CPC ..... *E21D 5/00* (2013.01); *E21D 11/152* (2013.01); *E21D 11/40* (2013.01); *E21D 20/00* (2013.01)

(58) Field of Classification Search

CPC . E21D 2011/406; E21D 11/40; E21D 11/381; E21D 19/02; E21B 19/087

USPC ..... 299/11, 18; 405/141, 146, 150.1, 288, 405/291, 296, 297, 302.3

See application file for complete search history.

(56) References Cited

U.S. PATENT DOCUMENTS

| | | | | |
|---|---|---|---|---|
| 3,399,927 | A | 9/1968 | Groetschel | |
| 4,122,682 | A | 10/1978 | Groetschel | |
| 4,196,935 | A | 4/1980 | Dring | |
| 4,229,043 | A | 10/1980 | Bell et al. | |
| 4,230,270 | A | 10/1980 | Poret | |
| 4,230,371 | A | 10/1980 | Bell et al. | |
| 4,339,216 | A | 7/1982 | Bell | |
| 4,358,159 | A | 11/1982 | Groetschel | |
| 4,379,660 | A | 4/1983 | Groetschel | |
| 5,199,825 | A * | 4/1993 | Travis | 405/296 |
| 5,277,520 | A * | 1/1994 | Travis | 405/129.6 |
| 5,816,750 | A | 10/1998 | Steffenino | |
| 6,981,559 | B2 * | 1/2006 | Rubie et al. | 173/184 |
| 8,137,033 | B1 | 3/2012 | Hinshaw et al. | |
| 8,662,796 | B2 * | 3/2014 | Brown | 405/302.3 |

(Continued)

FOREIGN PATENT DOCUMENTS

| | | | |
|---|---|---|---|
| DE | 2836659 A1 * | 3/1980 | E21C 11/00 |
| GB | 2046823 A | 11/1980 | |

*Primary Examiner* — Tara M. Pinnock

(74) *Attorney, Agent, or Firm* — King & Schickli, PLLC

(57) ABSTRACT

An apparatus applies mesh from a roll to a face of a mine passage. A spindle is adapted for supporting the roll of mesh. An arm supporting the spindle extends in a generally vertical direction and is adapted for rotation about an axis aligned with a direction of elongation of the mine passage such that the spindle traverses a path for applying the mesh from the roll to the face. A mast independent of the arm carries a drill head for drilling into the face of the mine passage. Related methods are also described.

12 Claims, 1 Drawing Sheet

(56) References Cited

U.S. PATENT DOCUMENTS

2004/0177979 A1* 9/2004 Rubie et al. ..... 173/28
2008/0279627 A1* 11/2008 Junker et al. ..... 404/75
2011/0150575 A1 6/2011 Brown
2012/0213598 A1* 8/2012 Lugg et al. ..... 405/290

* cited by examiner

MESH HANDLING APPARATUS AND RELATED METHODS

This application claims the benefit of U.S. Provisional Patent Application Ser. No. 61/684,423, the disclosure of which is incorporated herein by reference.

TECHNICAL FIELD

The present invention relates to the mining arts and, more particularly, to a mesh handling apparatus for an underground mining machine, such as a roof bolter.

BACKGROUND OF THE INVENTION

Anchors or "bolts" provide primary support for one or more of the faces of a passage in an underground mine, such as the roof or overburden. In connection with the installation of these bolts, it is often necessary or desired to install a reticulated mesh or grid material along the corresponding face(s). The main role of mesh is to provide passive confinement, especially in locations where poor ground conditions prevail, preventing fragments of rock and coal from falling from the roof and ribs in the spacing between reinforcing bolts.

Under the current approach, this supplemental protection afforded by the grid or mesh is separately applied to the roof and ribs of the mine passage, and oftentimes completed manually as part of the bolting operation. Past proposals have been made in an effort to facilitate the application of grid or mesh through semi-automated approaches, such as by having a roll of mesh or grid in flexible form carried by a mining machine and applied during the advance to form the mine passage.

Despite such advances, any manual approach suffers from being relatively complex in nature, and generally do not obviate the continued need for significant operator involvement. Specifically, an operator must still be involved to a significant extent in helping to initially support and tension the grid material or mesh during installation, and must also take measures to ensure that the proper amount of tension is provided throughout the operation. These requirements for frequent manual intervention increase the man hours and thus limit the practical effectiveness and efficiency of the limited automation provided.

Accordingly, a need is identified for an improved arrangement for use in applying a flexible grid material, or mesh, to a face of a mine passage. As compared with past approaches, the arrangement would be relatively simple in construction and inexpensive to implement. Yet, it would bring a significant level of advancement in terms of the savings in time and cost realized from its use. The result that follows from use of the system would be an overall increase in the efficiency of the mining operation.

SUMMARY

An apparatus for applying mesh from a roll to a face of a mine passage is disclosed. The apparatus comprises a spindle adapted for supporting the roll of mesh. An arm connected to the spindle extends in a generally vertical direction and adapted for rotation about an axis aligned with a direction of elongation of the mine passage such that the spindle traverses a path for applying the mesh from the roll to the face. A mast carries a drill head for drilling into the face of the mine passage, and the arm is independently movable relative to the mast.

The apparatus may further include a rotary actuator for rotating the arm about the path, as well as a boom for supporting the arm. The spindle (which may be mounted to the arm on one end and include a free end for receiving the roll of mesh) provides an axis of rotation for the roll of mesh, and the axis of rotation of the roll of mesh may be generally aligned with the axis of rotation of the arm. The boom may include a longitudinal axis generally in alignment with the axis of rotation of the arm and the axis of rotation of the roll about the spindle. The boom may support the mast, which may be connected to the boom in a manner that permits the arm to move independently of the mast. An automated temporary support extendable in the vertical direction may also be for contacting a roof of the mine passage.

A further aspect of this disclosure relates to an apparatus for providing support for a face of a mine passage by placing mesh from a roll along the face. The apparatus comprises a boom including a mast supporting a drill for drilling into the face of the mine passage. A support is provided for supporting the roll of mesh, and is mounted to the boom for movement independent of the mast to allow the support to traverse a path through the mine passage for applying the mesh from the roll to the face.

In one embodiment, the support comprises an extendable arm. The support may further comprise a spindle for supporting the mesh roll. The mast may be adapted for extending toward and away from the face of the mine passage. A rotary actuator may also be provided for rotating the support.

The disclosure also relates to an apparatus for providing support for a face of a mine passage including a longitudinal direction by placing mesh from a roll along the face. The apparatus comprises a spindle for supporting the roll of mesh. The apparatus further includes means for rotating the arm relative to the mast about an axis aligned with the longitudinal direction while applying the mesh onto the face.

Also disclosed are methods, such as a method of applying mesh carried by a rotatable arm for anchoring using a mast to a face of a mine passage having a longitudinal direction, a vertical direction, and a transverse direction. The method comprises, rotating the arm relative to the mast about an axis aligned with the longitudinal direction while applying the mesh to the face. The method may further include the step of extending or retracting the arm in one of the vertical direction or the transverse direction during the rotating step.

In one possible version, the method further comprises positioning the arm at a location for dispensing mesh from the roll onto the face and, during the rotating step, extending or retracting a first portion of the arm relative to a second portion of the arm to maintain the roll adjacent to the face. The method also includes using the mast to anchor the dispensed mesh to the face.

The method may also include the step of actuating the mast independent of the arm. The rotating step may comprise moving a point on the arm through an arcuate path. The rotating step may also comprise moving a point on the arm from a lower position to a higher position.

BRIEF DESCRIPTION OF THE DRAWING FIGURES

DETAILED DESCRIPTION

Figure 2:
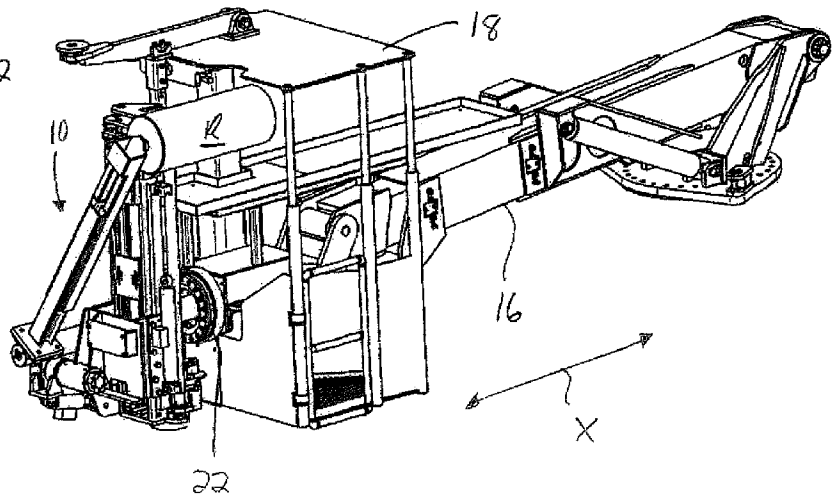
FIG. 2 is a perspective view of an entire boom carrying the mesh handling apparatus.
Figure 1:
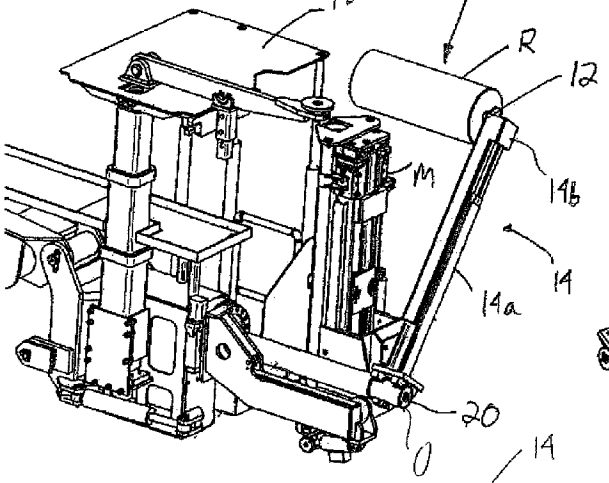
FIG. 1 is a partially cutaway perspective view of one embodiment of the mesh handling apparatus.
Figure 3:
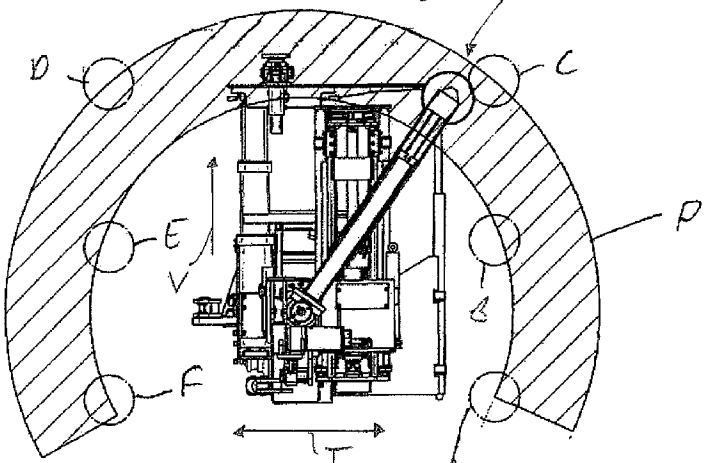
FIG. 3 in an end view schematically illustrating one possible mode of operation of the mesh handling apparatus.

Referring now to FIGS. 1-3, this disclosure relates primarily to a mining machine that incorporates an improved apparatus 10 for dispensing and applying mesh from a roll R to a face of a mine passage, such as along a portion of the roof, rib, or both (see, e.g., U.S. Pat. No. 8,137,033, the disclosure of which is incorporated herein by reference) during a single pass. The roll R is supported for rotation by a spindle 12, which is in turn supported in a cantilevered fashion by an arm 14 mounted for rotation along an generally arcuate (and potentially variably shaped in terms of the roll R location) path denoted using reference character P in FIG. 3.

In the depicted embodiment, the path P is generally transverse to a direction of elongation of an associated boom 16 supporting the apparatus 10, or transverse to a direction of elongation of the associated mine passageway (which typically corresponds to and is aligned with a direction of travel of the machine). Thus, as shown in FIG. 3, the arm 14 may traverse along the path P to apply the mesh to a section of the roof and ribs of the mine passage during a single pass, and once the pass is complete the machine carrying the boom 16 may then be moved longitudinally along the passage to apply mesh to a different section of the roof and ribs (including in connection with an automated temporary roof support 18). Rotational movement of the arm 14 along the path P while applying the mesh may be caused by means for rotating the arm relative to the mast about an axis X aligned with the longitudinal direction. The means may comprise a rotary actuator 20, which may comprise a hydraulic motor for causing the relative rotation.

Optionally, the arm 14 may be adapted for being lengthened or extended relative to the point O about which it pivots to follow the path P (or, stated, differently, in the radial direction), including during the dispensing of the mesh from the roll R. For example, the arm 14 may comprise a base portion 14*a* and an extendable portion 14*b* connected to and adapted to move relative to the base portion. The extendable portion 14*b* may carry the spindle 12 supporting the roll R at the distal end, and may be extended using type of linear actuator (such as an electric motor, hydraulic cylinder, a ball screw, or the like). Together, the portions 14*a*, 14*b* forming the extendable arm 14 and the actuator are considered means for lengthening the arm during the application or dispensing of the mesh.

Accordingly, as shown in FIG. 3, extension or retraction of the arm 14 allows for the mesh to be applied from the roll R along variously shaped paths, depending on the relative position of the mine surfaces to which the mesh is to be applied. Indeed, it should be appreciated that, by selectively extending and retracting the arm 14 during the rotary movement of the arm 14, the mesh may be applied in a generally linear path both horizontally along the roof and vertically along the ribs (note phantom depictions of roll A, B, C, D, E, F tracing a generally inverted U-shaped path, along with arrows indicating vertical axis V and transverse axis T, which are each generally perpendicular to the longitudinal axis X). Accordingly, and by way of example only, the variable length arm may extend a first distance through a first portion of the arc (such as from A to B), extended further during a second portion of the arc (B to C), variably extended and retracted during the next portion (C to D), and then selectively retracted (D to E and E to F).

It is also noted that the support, such as arm 14, is provided independent of the mast M, which may include anchoring means, such as a drill or drill head used to form boreholes and install fasteners (such as bolts) into one or more of these surfaces in connection with the application of the mesh. Optionally, this mast M may also be rotatably mounted to the boom 16 by an actuator 22 that allows the mast to pivot in different directions transverse to the direction of elongation of the passage (and independent of the rotation of the arm 14 about the longitudinal direction or the extension of the arm in the transverse (width) or vertical (height) direction) in order to secure the mesh once dispensed in position. As can be appreciated from FIG. 2, both the mast M and the apparatus 10 may be mounted to the same boom 16, and thus may be moved (e.g., raised or lowered) together, despite the capacity for independent actuation (e.g., rotation, extension, or both).

The foregoing descriptions of various embodiments are provided for purposes of illustration, and are not intended to be exhaustive or limiting. Modifications or variations are also possible in light of the above teachings. For example, the portions 14*a*, 14*b* of the arm may be nested or telescoping to provide the desired extension for the roll R. The term "generally" is used to connote a possible variance from an exact value (such as, for example, up to about 10%). The embodiments described above were chosen to provide the best application to thereby enable one of ordinary skill in the art to utilize the disclosed inventions in various embodiments and with various modifications as are suited to the particular use contemplated. All such modifications and variations (including the combination of any or all of the embodiments disclosed into a single apparatus) are within the scope of the invention.

The invention claimed is:

1. An apparatus for applying mesh from a roll to a face of a mine passage, comprising:

a spindle adapted for supporting the roll of mesh;

an arm for supporting the mesh, said arm extending in a generally vertical direction and adapted for rotation about an axis aligned with a direction of elongation of the mine passage such that the arm traverses a path for applying the mesh from the roll to the face;

a mast for carrying a drill for forming a borehole in the face of the mine passage and a boom for supporting the mast, the mast being connected to the boom in a manner that permits the arm to move independently of the mast, wherein the arm is mounted for rotation independent of the mast.

2. The apparatus of claim 1, further including a rotary actuator for rotating the arm about the path.

3. The apparatus of claim 1, wherein the boom supports the arm.

4. The apparatus of claim 3, wherein the spindle provides an axis of rotation for the roll of mesh, and the axis of rotation of the roll of mesh is generally aligned with the axis of rotation of the arm.

5. The apparatus of claim 4, wherein the boom includes a longitudinal axis in general alignment with the axis of rotation of the arm and the axis of rotation of the roll about the spindle.

6. The apparatus of claim 1, further including an automated temporary support extendable in the vertical direction for contacting a roof of the mine passage.

7. The apparatus of claim 1, wherein the spindle includes a first end connected to the arm and a second, free end for receiving the roll of mesh.

8. The apparatus of claim 1, wherein the arm is extendable in the vertical direction to move the mesh toward and away from the face.

9. An apparatus for providing support for a face of a mine passage by placing mesh from a roll along the face, comprising:

a boom including a mast supporting a drill for drilling into the face of the mine passage; and an extendable arm for supporting the mesh for application to the face of the mine passage, said extendable arm mounted to the boom for rotation independent of the mast to allow the extendable arm to traverse a path within the mine passage for applying the mesh from the roll to the face.

10. The apparatus of claim 9, wherein the extendable arm comprises a spindle for supporting the mesh roll, the spindle mounted in a cantilevered fashion and including a free end for receiving the roll of mesh.

11. The apparatus of claim 9, wherein the mast is extendable toward and away from the face.

12. The apparatus of claim 9, further including a first actuator for rotating the extendable arm, and a second rotary actuator for rotating the mast, the first and second actuators being supported by the boom.

* * * * *